US011235949B2

(12) United States Patent
Zhang

(10) Patent No.: US 11,235,949 B2
(45) Date of Patent: Feb. 1, 2022

(54) SAFETY DEVICE, ELEVATOR SAFETY SYSTEM AND ELEVATOR SYSTEM

(71) Applicant: Otis Elevator Company, Farmington, CT (US)

(72) Inventor: Lifeng Zhang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 663 days.

(21) Appl. No.: 16/041,161

(22) Filed: Jul. 20, 2018

(65) Prior Publication Data

US 2019/0023532 A1 Jan. 24, 2019

(30) Foreign Application Priority Data

Jul. 21, 2017 (CN) ..... 201710599185.6

(51) Int. Cl.
*B66B 5/22* (2006.01)
*B66B 5/18* (2006.01)

(52) U.S. Cl.
CPC . *B66B 5/22* (2013.01); *B66B 5/18* (2013.01)

(58) Field of Classification Search
CPC .... B66B 5/18; B66B 5/20; B66B 5/22; B66B 5/24
See application file for complete search history.

(56) References Cited

U.S. PATENT DOCUMENTS 924,750 A * 6/1909 Driscoll ..... B66B 5/22 187/372
3,869,024 A * 3/1975 Hauth ..... F16D 55/46 188/72.5
5,096,020 A 3/1992 Korhonen
5,159,995 A 11/1992 Sissala et al.
5,230,406 A * 7/1993 Poon ..... B66B 5/22 187/376
6,176,350 B1 1/2001 Schlosser
6,997,287 B2 * 2/2006 Sasaki ..... B66B 5/22 187/376
CN 2685301 3/2005
CN 2717919 8/2005
(Continued)

FOREIGN PATENT DOCUMENTS

CN 1182709 A 5/1998
CN 2623667 Y 7/2004
(Continued)

OTHER PUBLICATIONS

European Search Report for application EP 18184752, dated Nov. 30, 2018, U320950EP, 19 pages.
(Continued)

*Primary Examiner* — Minh Truong
(74) *Attorney, Agent, or Firm* — Cantor Colburn LLP

(57) ABSTRACT

The present invention provides a safety device, an elevator safety system and an elevator system. The elevator safety system comprises the safety device which comprises a shell having a vertical passage for elevator guide rails to pass through, the safety device further comprises a first brake block on a first side of the vertical passage, and a second brake block on a second opposite side of the vertical passage; and a safety device carrier for supporting the safety device and fixedly connected to an elevator car; wherein the shell of the safety device is obliquely and movably mounted on the safety device carrier.

15 Claims, 3 Drawing Sheets

(56) References Cited

U.S. PATENT DOCUMENTS

| | | | | |
|---|---|---|---|---|
| 7,721,852 | B2 * | 5/2010 | Ishioka | B66B 7/08 187/391 |
| 9,457,990 | B2 | 10/2016 | Osmanbasic et al. | |
| 9,643,815 | B2 * | 5/2017 | Wei | B66B 5/00 |
| 9,663,327 | B2 | 5/2017 | Terry et al. | |
| 10,889,468 | B2 * | 1/2021 | Hu | B66B 5/04 |
| 2008/0128218 | A1 * | 6/2008 | Gremaud | B66B 5/22 187/250 |
| 2011/0088983 | A1 * | 4/2011 | Sirigu | B66B 5/22 187/373 |
| 2016/0200549 | A1 * | 7/2016 | Billard | B66B 5/24 188/65.1 |
| 2016/0289045 | A1 | 10/2016 | Osmanbasic et al. | |
| 2016/0348745 | A1 | 12/2016 | Leichtfried et al. | |
| 2019/0345003 | A1 * | 11/2019 | Fauconnet | B66B 5/22 |

FOREIGN PATENT DOCUMENTS

| | | | |
|---|---|---|---|
| CN | 101575062 | B | 5/2011 |
| CN | 203450992 | U | 2/2014 |
| CN | 105329739 | A | 2/2016 |
| CN | 205838249 | U | 12/2016 |
| EP | 0957059 | A2 | 11/1999 |
| EP | 1568643 | A1 | 8/2005 |
| EP | 1942071 | B1 | 11/2010 |
| JP | 2008303014 | A | 12/2008 |
| JP | 2013227116 | A | 11/2013 |
| WO | 2008057116 | A1 | 5/2008 |

OTHER PUBLICATIONS

Chinese Office Action for Application No. 201710599185.6; dated Aug. 27, 2020; 6 Pages.

* cited by examiner

SAFETY DEVICE, ELEVATOR SAFETY SYSTEM AND ELEVATOR SYSTEM

FOREIGN PRIORITY

This application claims priority to Chinese Patent Application No. 201710599185.6, filed Jul. 21, 2017, and all the benefits accruing therefrom under 35 U.S.C. § 119, the contents of which in its entirety are herein incorporated by reference.

TECHNICAL FIELD

The present invention relates to the technical field of elevator safety systems, and more particularly, the present invention relates to an elevator safety system, a safety device therein and an elevator system therewith.

BACKGROUND ART

An elevator system is configured with a safety device such as a safety gear to stop the elevator by friction with the guide rails when a car is overspeed. There is provided an asymmetric safety device in the prior art, which only has a sliding wedge block at one side of the guide rail and a fixed wedge block is arranged at the other side of the guide rail. When the elevator is overspeed, the safety device is actuated by a speed limiter, such that the sliding wedge block is engaged with the elevator guide rail to cause an overall offset of the safety device and the car, and also the engagement of the fixed wedge block with the guide rail, thereby causing the wedge blocks on both sides of the guide rail to clamp the guide rail to provide a braking force. However, due to the overall offset of the safety device and the car, a pressure between car guide shoes and the guide rail is produced, which may destroy the guide shoes and may also affect the stability of the braking force by the safety device. With regard to the safety device, the braking force follows a strict standard, an excessively large braking force would cause an impact on the car, and an excessively small braking force may cause the car to fail in braking in time and to fall into the bottom of an elevator shaft, and therefore, such a fluctuation in the braking force is not expected.

US Patent Publication No. US005159995A discloses a support structure for a safety device, wherein the safety device is mounted on a frame of a car with a transverse pillar with an elastic element, thereby allowing the safety device to translate along the horizontal direction perpendicular to the guide rails.

SUMMARY OF THE INVENTION

An objective of the present invention is to solve or at least relieve the problems in the prior art.

Another objective of the present invention is to provide a safety device with a simplified structure and an elevator safety system and an elevator system therewith.

Yet another objective of the present invention is to improve the stability of a braking force of the safety device.

Still a further objective of the present invention is to automatically reset the actuated safety device with a simplified structure.

One additional objective of the present invention is to automatically reset the safety device to an initial position to ensure a gap between wedging block and guide rail.

In order to realize the above or other objectives, there is provided an elevator safety system, comprising: a safety device, comprising a shell having a vertical passage for the elevator guide rails to pass through, the safety device further comprising a first brake block on a first side of the vertical passage, and a second brake block on a second opposite side of the vertical passage; and a safety device carrier for supporting the safety device and fixedly connected to an elevator car; wherein the shell of the safety device is obliquely and movably mounted on the safety device carrier.

In another aspect, there is provided an elevator system, comprising: guide rails; a car moving along the guide rails; a speed limiting device, monitoring the moving speed of the car, and actuating an elevator safety system when the car is overspeed; and an elevator safety system according to various embodiments.

DESCRIPTION OF THE DRAWINGS

The disclosed content of the present invention is easier to understand with reference to the drawings. It is easily understood by those skilled in the art that these drawings are merely intended for illustration rather than limiting a protective scope of the present invention. In addition, the similar numbers in the drawings are used for representing the similar parts. In the drawings.

DETAILED DESCRIPTION

It is easily understood that according to the technical solution of the present invention, without altering the essential spirit of the present invention, those ordinary skilled in the art could propose multiple mutually substitutive structural forms and implementing modes. Therefore, the following specific embodiments and drawings merely illustratively explain the technical solution of the present invention, and should not be considered as all of the present invention or to define or limit the technical solution of the present invention.

The direction terms such as upper, lower, left, right, front, back, front face, back face, top and bottom that are mentioned or possibly mentioned in the present description are defined relative to the configurations as shown in respective drawings, and they are relative concepts, and thus may be correspondingly changed according to different positions, and different use states thereof. Therefore, these or other direction terms should not be explained as limitative terms.

Figure 1:
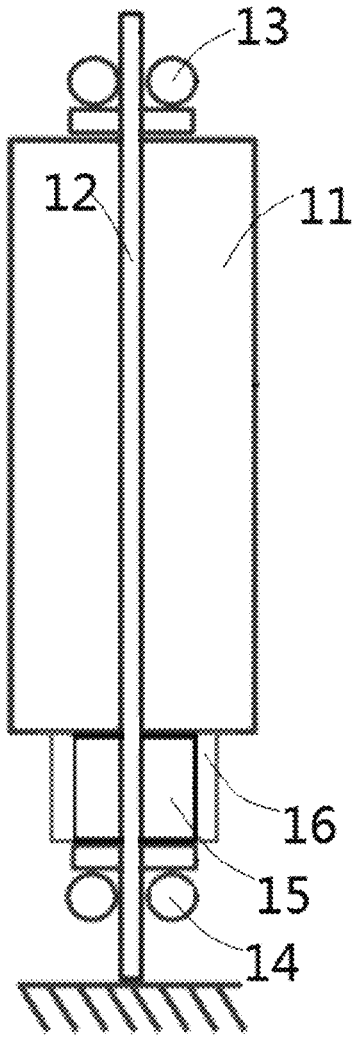
FIG. 1 shows a schematic diagram of an elevator system.

Firstly, with reference to FIG. 1, FIG. 1 shows a side view of part of an elevator system. The elevator system comprises a car 11, two sides of the car 11 have guide rails 12 (one of which is visible), and the car 11 may move along the guide rails by for example guide shoes 13 on the top and guide shoes 14 on the bottom. For example, the bottom (or other positions) of the car 11 may be provided with an elevator safety system which comprises a safety device carrier 16 for supporting a safety device 15 and fixedly connected to the elevator car 11. The elevator safety system further comprises the safety device 15, which comprises a shell having a vertical passage for the elevator guide rails 12 to pass through, and further comprises a first brake block on a first side of the vertical passage and a second brake block on a second opposite side of the vertical passage, wherein at least one of the brake blocks is engaged with the guide rail 12 in response to the actuation of a speed limiter, and causes the guide rail 12 to be clamped by the brake blocks on both sides, such that the car is stopped by a friction force. In the safety system according to the present invention, the shell of the safety device 15 may be obliquely and movably mounted on the safety device carrier 16.

Figure 2:
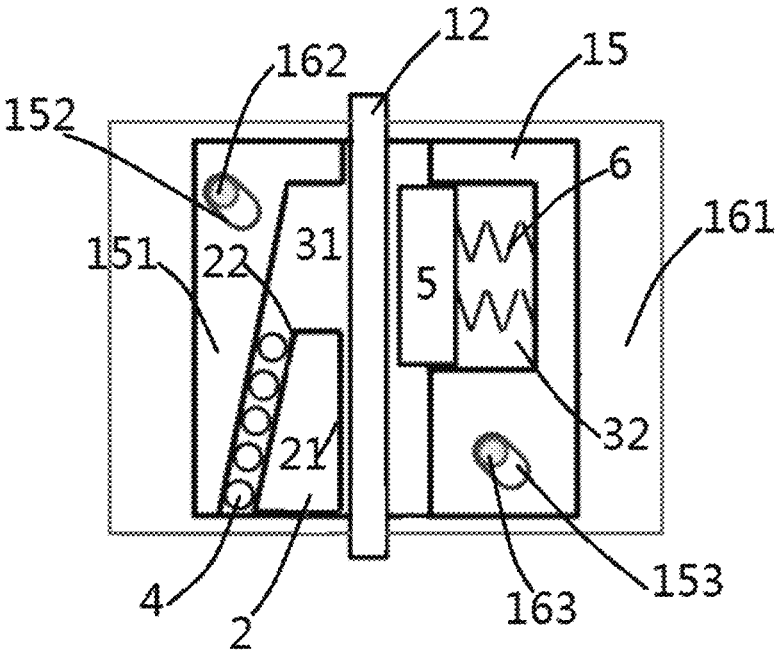
FIG. 2 shows a schematic diagram when the elevator safety system according to an embodiment of the present invention is not actuated.

FIG. 2 shows an enlarged view of the elevator safety system according to an embodiment of the present invention. FIG. 2 clearly shows that the safety device carrier 16 has a mounting plate 161 part for movably supporting the safety device 15, and the safety device carrier 16 may also have a connecting part so as to be connected to the elevator car 11. The safety device 15 has a vertical passage through which the guide rail 12 passes. A first brake block 2 is disposed on a first side of the vertical passage or the guide rail 12, and a second brake block 5 is disposed on a second side of the vertical passage or the guide rail 12. The shell of the safety device 15 may be obliquely and movably mounted on the safety device carrier 16, for example, in the embodiment as shown in FIG. 2, the shell 151 of the safety device 15 is provided with oblique guide grooves 152, 153, and bolts 162, 163 pass through the oblique guide grooves 152, 153 in the shell 151 of the safety device 15 and are mounted to the safety device carrier 16, for example, the bolts may be inserted into through holes of the mounting plate 161 of the safety device carrier 16, and received by nuts. In an alternative embodiment, the shell of the safety device 15 may also be obliquely and movably mounted on the safety device carrier 16 in other manners, for example, the safety device carrier 16 may be provided with the oblique guide grooves, and the bolts pass through the oblique guide grooves in the safety device carrier 16 and are fixedly mounted on the safety device 15. In addition, in other alternative embodiments, the shell of the safety device 15 may be obliquely and movably mounted on the safety device carrier 16 by structures such as a guide rail structure, a key way structure, a sliding block structure or a structure of another proper form.

In the embodiment adopting the bolts and the oblique guide grooves as shown in the drawings, each of the oblique guide grooves may be disposed to form a certain angle with the horizontal direction, for example, the angle between each of the oblique guide grooves and the horizontal direction may be for example greater than 30 degrees, or greater than 45 degrees, or between 30 degrees and 45 degrees, or between 45 degrees and 60 degrees, or even greater than 60 degrees. The orientation of the oblique guide grooves may be designed according to the specific situation.

In some embodiments, in order to enable the shell of the safety device to be mounted on the safety device carrier 16 in a more balanced and steady manner, a plurality of oblique guide grooves parallel to each other may be disposed in the shell of the safety device, for example, two, three, four or more. In some embodiments, as shown in FIG. 2, the safety device 15 is merely provided with a pair of parallel oblique guide grooves at diagonal positions of the shell 151, in some embodiments, such pair of oblique guide grooves may be disposed collinearly. Although by more oblique guide grooves, the shell of the safety device can be supported more steadily and respective bolts can be subjected to a more uniform force, the increase of the oblique guide grooves is limited by the structure of the shell, and may cause difficulty in sliding of the shell due to machining tolerance. Therefore, in the embodiment as shown in the drawing, a pair of oblique guide grooves only at the diagonal positions of the shell of the safety device is adopted. In the embodiment of FIG. 2, since only two oblique guide grooves are adopted, in order to cause the safety device to be supported more steadily, the oblique guide grooves may pass through the whole shell 151 of the safety device 15, in other words, pass through the whole thickness of the shell 151 of the safety device.

In some embodiments of the present invention, the shell 151 of the safety device 15 defines a first cavity 31 on the first side of the passage, the first brake block 2 is a sliding wedge block, and the sliding wedge block has a shape matching the first cavity 31, and may operably slide in the first cavity 31 up and down. In the embodiment as shown in FIG. 2, the first cavity 31 has a trapezoidal shape, and correspondingly, the first brake block 2 also has a trapezoidal shape and has an inner side 21 facing the guide rail and an outer side 22 facing the first cavity. In some embodiments, the shell defines a first oblique guide groove 152 in the outer side of an oblique side of the first cavity on the first side of the passage. In some embodiments, the first oblique guide groove 152 is oriented to intersect with the oblique side of the first cavity 31, in other words, an extending line of the first oblique guide groove 152 intersects with the oblique side of the first cavity 31 within the shell 151 of the safety device. Optionally, idler wheels 4 are disposed between the outer side of the oblique side 22 of the first brake block 2 and the first cavity.

In some embodiments, the shell 151 of the safety device 15 defines a second cavity 32 on the second opposite side of the passage, and the second brake block 5 is a fixed wedge block in the second cavity 32. In some embodiments, the shell defines a second oblique guide groove 153 below the second cavity on the second side of the passage, and the second oblique guide groove 153 is oriented to be parallel to the first oblique guide groove 152. In some embodiments, the fixed wedge block 5 may be supported by an elastic device 6 to provide an elastic resisting force. Although in the drawing, the elastic device 6 is disposed to horizontally provide a resisting force to the fixed wedge block 5, in an alternative embodiment, the elastic device 6 may also be disposed to provide a horizontal resisting force to the fixed wedge block 5 along an oblique direction. In some embodiments, the elastic device 6 may be formed by a disk spring.

Figure 3:
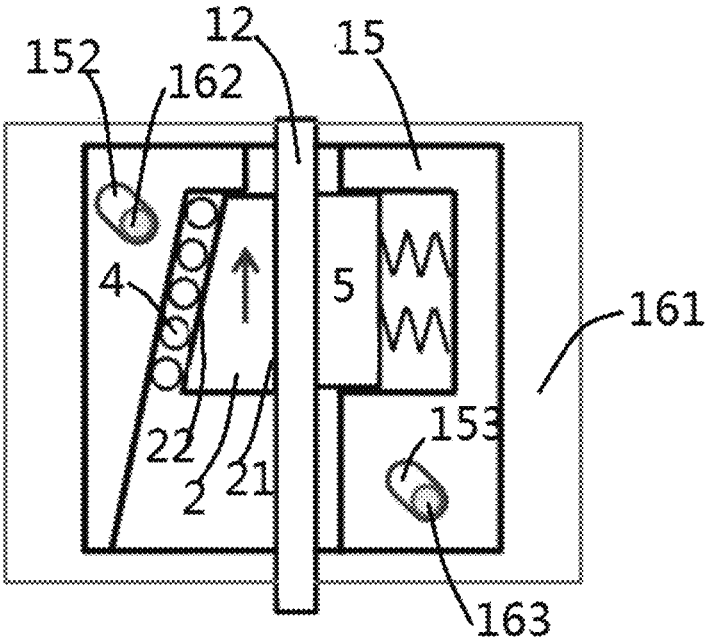
FIG. 3 shows a schematic diagram when the elevator safety system according to an embodiment of the present invention is actuated.
Figure 4:
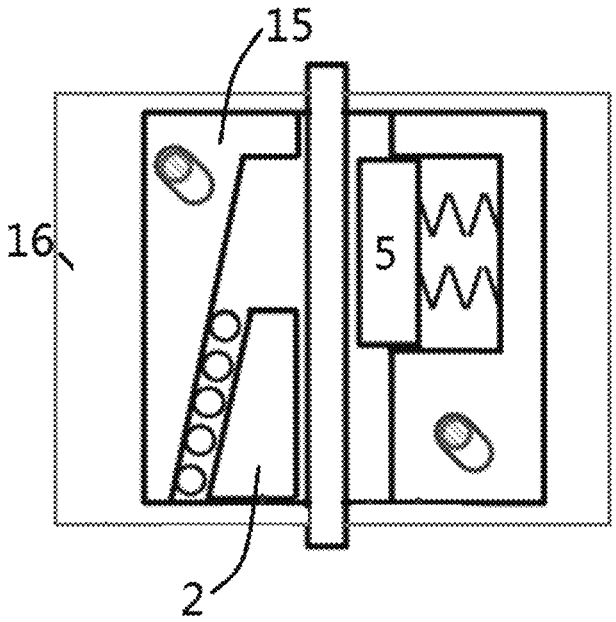
FIG. 4 shows a schematic diagram after the elevator safety system according to an embodiment of the present invention returns to a normal operation state.

How the safety system according to an embodiment of the present invention works is now described in combination with FIGS. 2 to 4. In the case as shown in FIG. 2, the guide rails 12 are not in contact with the brake blocks of the safety device, and the elevator car 11 ascends or descends along the guide rails 12 via the guide shoes. When an emergency occurs to the elevator, for example, the descending speed of the elevator is overspeed, the elevator safety system is actuated by for example the speed limiter. The first brake block 2 is lifted up by for example a lifting rod of the speed limiter, the inner side 21 of the first brake block 2 is engaged with the elevator guide rail 12 to provide a braking force, and the outer side 22 of the first brake block 2 acts on the shell 151 of the safety device 15, such that the shell 151 of the safety device moves toward the outer side (the left side in the drawing) and upward relative to the safety device carrier 16 along an oblique direction until the position as shown in FIG. 3, wherein the bolts 162, 163 reach the approximate bottom positions of the oblique guide grooves 152, 153. In one aspect, the shell 151 of the safety device moves leftward relative to the safety device carrier 16 in the process, such that the second brake block 5 can be engaged with the guide rail 12, thereby causing the first wedge block 2 and the second wedge block 5 to clamp the guide rail 12 from both sides to stop the car connected to the safety device 15 by friction. In the other aspect, the shell 151 of the safety device also moves upward relative to the safety device carrier 16, therefore, after the emergency is removed, as shown in FIG. 4, the shell of the safety device 15 can be moved toward the inner side (rightward) and downward along an oblique direction due to, at least partially, the gravity per se by releasing the first brake block 2 until the bolts 162, 163 reach the top of the oblique guide grooves 152, 153. Hence, the shell of the safety device is totally returned to the initial position, and it can be guaranteed that there is a preset proper gap between the first brake block and the second brake block of the safety device 15 and the guide rail 12.

In another aspect, there is provided a safety device, comprising a shell 151 having a vertical passage for the elevator guide rails 12 to pass through, and the safety device further comprises a first brake block 2 on a first side of the vertical passage, and a second brake block 5 on a second opposite side of the vertical passage, wherein the shell of the safety device is provided with oblique guide grooves 152, 153. The safety device may also have all characteristics described above for the safety device, alone or in combination.

In yet another aspect, there is provided an elevator system, comprising guide rails 12; a car 11 moving along the guide rails 12; a speed limiting device (not shown) monitoring the moving speed of the car, and actuating a safety system when the car is overspeed; and the elevator safety system according to various embodiments of the present invention.

The specific embodiments mentioned above are merely intended to more clearly describe the principle of the present invention, and the respective parts are clearly shown or described to make the principle of the present invention easier to understand. Without departing from the scope of the present invention, various modifications or changes can be easily made to the present invention by those skilled in the art. Thus, it should be understood that these modifications or changes should fall within the protective scope of the present invention.

What is claimed is:

1. An elevator safety system, comprising:

a safety device, comprising a shell having a vertical passage for elevator guide rails to pass through, the safety device further comprising a first brake block on a first side of the vertical passage, and a second brake block on a second opposite side of the vertical passage, the first brake block and the second brake block movable with respect to the shell; and a safety device carrier for supporting the safety device and fixedly connected to an elevator car;

wherein the shell of the safety device is obliquely and movably mounted on the safety device carrier such that the shell is configured to move in a direction oblique to the vertical passage;

wherein the shell defines a first cavity on the first side of the passage, the first brake block is a sliding wedge block, and the sliding wedge block has a shape matching the first cavity, and is capable of operably sliding in the first cavity up and down;

wherein the first cavity on the first side of the passage is trapezoid, a first oblique guide groove is defined in an outer side of an oblique side of the first cavity, and the first oblique guide groove is oriented to intersect with the oblique side of the first cavity.

2. The elevator safety system according to claim 1, wherein the shell of the safety device is provided with oblique guide grooves, and bolts pass through the oblique guide grooves in the shell of the safety device and are fixedly mounted to the safety device carrier.

3. The elevator safety system according to claim 2, wherein the oblique guide groove and the horizontal direction form an angle greater than 30 degrees.

4. The elevator safety system according to claim 2, wherein the oblique guide grooves are parallel to each other.

5. The elevator safety system according to claim 2, wherein the shell of the safety device is provided with a pair of oblique guide grooves parallel to each other.

6. The elevator safety system according to claim 2, wherein the oblique guide grooves pass through the whole shell of the safety device.

7. The elevator safety system according to claim 1, wherein when the elevator safety system is actuated, the first brake block is lifted up, an inner side of the first brake block is engaged with the elevator guide rail to provide a braking force, and the outer side of the first brake block acts on the shell of the safety device, such that the shell of the safety device moves outward and upward along an oblique direction relative to the safety device carrier, and when the elevator safety system is restored, the first brake block is released, and the shell of the safety device moves inward and downward along an oblique direction relative to the safety device carrier due to gravity.

8. The elevator safety system according to claim 1, wherein idler wheels are disposed between an outer side of the first brake block and the first cavity.

9. The elevator safety system according to claim 1, wherein the shell defines a second cavity on a second opposite side of the passage, and the second brake block is fixed in the second cavity.

10. The elevator safety system according to claim 9, wherein the shell defines a second oblique guide groove below the second cavity on the second side of the passage, and the second oblique guide groove is oriented to be parallel to the first oblique guide groove.

11. The elevator safety system according to claim 9, wherein the fixed wedge block is supported by an elastic device providing a horizontal resisting force.

12. An elevator system, comprising:

guide rails;

a car moving along the guide rails;

a speed limiting device, monitoring the moving speed of the car, and actuating an elevator safety system when the car is overspeed; and the elevator safety system according to claim 1.

13. A safety device, comprising a shell having a vertical passage for elevator guide rails to pass through, the safety device further comprising a first brake block on a first side of the vertical passage, and a second brake block on a second opposite side of the vertical passage, the first brake block and the second brake block movable with respect to the shell, wherein the shell of the safety device is provided with oblique guide grooves such that the shell is configured to move in a direction oblique to the vertical passage;

wherein the shell defines a first cavity on the first side of the passage, the first brake block is a sliding wedge block, and the sliding wedge block has a shape matching the first cavity, and is capable of operably sliding in the first cavity up and down;

wherein the first cavity on the first side of the passage is trapezoid, a first oblique guide groove is defined in an outer side of an oblique side of the first cavity, and the first oblique guide groove is oriented to intersect with the oblique side of the first cavity.

14. The safety device according to claim 13, wherein the oblique guide groove and the horizontal direction form an angle greater than 30 degrees.

15. The safety device according to claim 13, wherein the oblique guide grooves pass through the whole shell of the safety device.

* * * * *